US010635019B2

(12) United States Patent
Doi et al.

(10) Patent No.: US 10,635,019 B2
(45) Date of Patent: Apr. 28, 2020

(54) DEVELOPING ROLLER, ELECTROPHOTOGRAPHIC PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Noriyuki Doi, Numazu (JP); Ryo Sugiyama, Mishima (JP); Minoru Nakamura, Mishima (JP); Seiji Tsuru, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/540,463

(22) Filed: Aug. 14, 2019

(65) Prior Publication Data

US 2020/0073278 A1 Mar. 5, 2020

(30) Foreign Application Priority Data

Aug. 31, 2018 (JP) ..... 2018-163166

(51) Int. Cl.
*G03G 15/08* (2006.01)

(52) U.S. Cl.
CPC ..... *G03G 15/0808* (2013.01); *G03G 15/0818* (2013.01); *G03G 2215/0617* (2013.01); (Continued)

(58) Field of Classification Search
CPC ..... G03G 15/0808; G03G 15/0818; G03G 2215/0617; G03G 2215/0858; G03G 2215/0861
See application file for complete search history.

(56) References Cited

U.S. PATENT DOCUMENTS 7,727,134 B2 6/2010 Nakamura et al.
7,797,833 B2 9/2010 Nakamura et al.
(Continued)

FOREIGN PATENT DOCUMENTS

JP H04-50879 2/1992
JP H04-88381 3/1992
(Continued)

OTHER PUBLICATIONS

U.S. Appl. No. 16/516,790, filed Jul. 19, 2019, Kazutoshi Ishida.
(Continued)

*Primary Examiner* — Joseph S Wong
(74) *Attorney, Agent, or Firm* — Venable LLP

(57) ABSTRACT

Provided is a developing roller comprising an electroconductive substrate and an electroconductive layer thereon, the electroconductive layer retaining resin particles so that at least a part of each of the resin particles is exposed on an outer surface of the developing roller; the outer surface of the developing roller constituted by electrically insulating domains and an electroconductive matrix, assuming that a square region 200-μm in a side is put on the outer surface of the developing roller, the square region including the domains, among the domains in the square region at least two of them satisfying specific condition, and assuming that the outer surface of the developing roller is charged, and creating a potential map of the charged outer surface of the developing member, the two domains satisfying the specific condition being ascertained in the potential map.

11 Claims, 6 Drawing Sheets

(52) U.S. Cl.
CPC ..... *G03G 2215/0858* (2013.01); *G03G 2215/0861* (2013.01)

(56) References Cited

U.S. PATENT DOCUMENTS

| | | | |
|---|---|---|---|
| 7,798,948 | B2 | 9/2010 | Kawamura et al. |
| 7,799,398 | B2 | 9/2010 | Nakamura et al. |
| 8,298,670 | B2 | 10/2012 | Muranaka et al. |
| 8,449,975 | B2 | 5/2013 | Hirakoso et al. |
| 8,655,222 | B2 | 2/2014 | Nakamura et al. |
| 8,655,238 | B2 | 2/2014 | Uno et al. |
| 8,768,227 | B2 | 7/2014 | Urushihara et al. |
| 8,798,508 | B2 | 8/2014 | Yamada et al. |
| 8,874,007 | B2 | 10/2014 | Kawamura et al. |
| 9,023,465 | B2 | 5/2015 | Yamada et al. |
| 9,556,359 | B2 | 1/2017 | Suzumura et al. |
| 9,625,854 | B2 | 4/2017 | Koyanagi et al. |
| 9,811,021 | B2 | 11/2017 | Muranaka et al. |
| 9,846,407 | B2 | 12/2017 | Nakamura et al. |
| 9,921,513 | B2 | 3/2018 | Masu et al. |
| 9,921,518 | B2 | 3/2018 | Sakurai et al. |
| 9,952,531 | B2 | 4/2018 | Ishii et al. |
| 9,952,532 | B2 | 4/2018 | Sugiyama et al. |
| 9,989,879 | B2 | 6/2018 | Doi et al. |
| 10,036,971 | B2 | 7/2018 | Doi et al. |
| 10,078,286 | B2 | 9/2018 | Takeno et al. |
| 10,310,447 | B2 | 6/2019 | Morishita et al. |
| 10,365,576 | B2 | 7/2019 | Doi et al. |
| 10,459,356 | B2 | 10/2019 | Takeno et al. |
| 2012/0308261 | A1 | 12/2012 | Tsuru et al. |
| 2013/0130022 | A1 | 5/2013 | Uesugi et al. |
| 2013/0164038 | A1 | 6/2013 | Kusaba et al. |
| 2013/0266339 | A1 | 10/2013 | Sugiyama et al. |
| 2014/0072343 | A1 | 3/2014 | Masu et al. |
| 2014/0080691 | A1 | 3/2014 | Kurachi et al. |
| 2016/0139534 | A1* | 5/2016 | Suzuki ..... G03G 15/0818 399/286 |
| 2016/0363881 | A1* | 12/2016 | Urushihara ..... G03G 15/0808 |
| 2017/0139346 | A1 | 5/2017 | Ishida et al. |
| 2019/0265609 | A1 | 8/2019 | Sakurai et al. |
| 2019/0324379 | A1* | 10/2019 | Furukawa ..... G03G 15/0216 |
| 2019/0324382 | A1 | 10/2019 | Sugiyama et al. |

FOREIGN PATENT DOCUMENTS

| | | |
|---|---|---|
| JP | 2004-037666 | 2/2004 |
| JP | 2007-138034 | 6/2007 |
| JP | 2017-090824 | 5/2017 |

OTHER PUBLICATIONS

U.S. Appl. No. 16/524,794, filed Jul. 29, 2019, Shohei Urushihara.
U.S. Appl. No. 16/525,693, filed Jul. 30, 2019, Seiji Tsuru.
U.S. Appl. No. 16/526,125, filed Jul. 30, 2019, Sosuke Yamaguchi.
U.S. Appl. No. 16/541,732, filed Aug. 14, 2019, Kazuhito Wakabayashi.
U.S. Appl. No. 16/545,434, filed Aug. 20, 2019, Kenta Matsunaga.
U.S. Appl. No. 16/569,768, filed Sep. 13, 2019, Fumihiko Utsuno.
U.S. Appl. No. 16/672,770, filed Nov. 4, 2019, Wataru Moriai.
U.S. Appl. No. 16/695,754, filed Nov. 26, 2019, Kazutoshi Ishida.

* cited by examiner

DEVELOPING ROLLER, ELECTROPHOTOGRAPHIC PROCESS CARTRIDGE AND ELECTROPHOTOGRAPHIC IMAGE FORMING APPARATUS

BACKGROUND

The present disclosure relates to a developing roller for electrophotography, an electrophotographic process cartridge and an electrophotographic image forming apparatus.

DESCRIPTION OF THE RELATED ART

It is known to form an electrostatic latent image on the surface of an electrophotographic photosensitive member (hereinafter, sometimes referred to as "photosensitive member") as a rotatable electrostatic latent image carrier and develop the electrostatic latent image by toner at a contact portion of the photosensitive member with a developing roller in an electrophotographic image forming apparatus.

Japanese Patent Application Laid-Open No. H04-50879 and Japanese Patent Application Laid-Open No. H04-88381 each disclose a developing roller having a surface layer with an insulating particle dispersed in an electroconductive material. Such a developing roller enables a large number of minute closed electric fields (microfields) to be formed in the vicinity of the surface of the developing roller, resulting in an enhancement in toner conveyance ability.

According to studies by the present inventors, the developing roller according to Japanese Patent Application Laid-Open No. H04-50879 and Japanese Patent Application Laid-Open No. H04-88381 has not yet been sufficient in the conveyance ability of the developer. Such lack in developer conveyance ability can cause the occurrence of roughness in an electrophotographic image.

SUMMARY

One aspect of the present disclosure is directed to providing a developing roller which is high in developer conveyance ability and which enables a high-quality electrophotographic image to be formed. Another aspect of the present disclosure is directed to providing an electrophotographic process cartridge which contributes to formation of a high-quality electrophotographic image. Still another aspect of the present disclosure is directed to providing an electrophotographic image forming apparatus which enables a high-quality electrophotographic image to be formed.

According to one aspect of the present disclosure, there is provided a developing roller comprising:

an electroconductive substrate; and an electroconductive layer on the substrate, wherein the electroconductive layer retains resin particles so that at least a part of each of the resin particles is exposed on an outer surface of the developing roller, the outer surface of the developing roller is constituted by electrically insulating domains, and an electroconductive matrix, each of the electrically insulating domains being constituted by the part of each of the resin particles exposed on the outer surface of the developing roller, and the electroconductive matrix being a part of an outer surface of the electroconductive layer, wherein assuming that a square region 200-μm on a side is put on the outer surface of the developing roller so that one side of the square region is along a longitudinal direction of the developing roller, the square region includes a plurality of the electrically insulating domains, and at least two electrically insulating domains among the plurality of the electrically insulating domains in the square region satisfy the following condition 1, Condition 1: having an equivalent circle diameter of 10 μm or more and 80 μm or less respectively, and having an inter-wall distance therebetween of 10 μm or more and 100 μm or less; and wherein assuming that the outer surface of the developing roller where the square region is put is charged with a discharging wire disposed parallel to the longitudinal direction of the developing roller and at a location 2 mm away from the outer surface of the developing roller, by applying a direct voltage of −5 kV between the substrate and the discharge wire in an environment of a temperature of 23° C. and a relative humidity of 50%, and assuming that the square region is equally divided by 50 straight lines parallel to one side of the square region and 50 straight lines perpendicular to the straight lines, a potential at each point of intersection between those straight lines with an electrical force microscope is measured, and a potential map of the charged outer surface of the developing roller on which the square region is put, is created, the presence of each of the two domains satisfying the condition 1, is ascertained in the potential map.

According to another aspect of the present disclosure, there is provided an electrophotographic process cartridge detachably attachable to a main body of an electrophotographic image forming apparatus, including a developing roller, wherein the developing roller is the above-mentioned developing roller.

According to still another aspect of the present disclosure, there is provided an electrophotographic image forming apparatus including a developing roller, wherein the developing roller is the above-mentioned developing roller.

Further features of the present disclosure will become apparent from the following description of exemplary embodiments with reference to the attached drawings.

BRIEF DESCRIPTION OF THE DRAWINGS

FIG. 3A is a potential map in charging of a 200-μm square region on the outer surface of the developing roller.

FIG. 3B is a schematic view of an observed image of the above region, with an optical microscope.

FIG. 4A is a potential map in charging of a 200-μm square region on the outer surface of the developing roller. FIG. 4B is a schematic view of an observed image of the above region, with an optical microscope.

DESCRIPTION OF THE EMBODIMENTS

Figure 1:
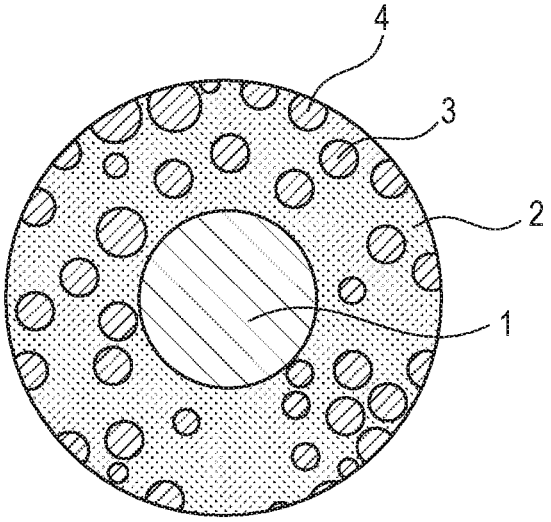
FIG. 1 includes a cross-sectional schematic view illustrating one example of a developing roller according to one aspect of the present disclosure.

We have made intensive studies in order to enhance the ability for conveying the toner of the developing roller as disclosed in Japanese Patent Application Laid-Open No. H04-50879 and Japanese Patent Application Laid-Open No. H04-88381. A developing roller where an electrically insulating first region and a second region lower in electric resistance than the first region are present on the outer surface allows the first region to be charged, resulting in generation of a potential difference between the first region and the second region, and adsorption of a developer to the vicinity of the first region due to a gradient force. Thus, a stable amount of the developer can be retained on the outer surface.

The gradient force means a force having an influence on an article present in an electric field gradient generated between regions different in potential. The gradient force is a force generated by generating a slope (large and small) of polarization in any article present in the electric field gradient, depending on the electric field strength, resulting in traveling of the article in a direction where the polarization is larger, namely, in a direction where the electric field strength is stronger. Such an electric field gradient which imparts the gradient force can be generated by allowing surfaces different in potential to be present in a positional relationship where the surfaces do not face to each other, as in, for example, a case where regions different in potential are provided on the same plane surface.

However, when a plurality of such first regions are physically extremely adjacently located, specifically, for example, the distance between the respective wall surfaces of two first regions is 100 μm or less, a potential difference between the two first regions and a second region interposed therebetween is insufficient. A sufficient gradient force is hardly generated on respective boundary portions facing to each other, of the two first regions. Thus, it is considered that a sufficient amount of a developer hardly adsorbs to the vicinity of the boundary portions facing to each other, of the two first regions.

We have made studies about a sufficient increase in potential difference between also first regions extremely adjacently located and a second region interposed therebetween, based on such considerations. It is considered that, if the potential difference can be increased, a sufficiently large gradient force can be generated even on the boundary portions facing to each other, of the two first regions, resulting in a much more enhancement in the amount of a developer to be conveyed.

That is, a developing roller according to one aspect of the present disclosure includes an electroconductive substrate and an electroconductive layer on the substrate. The electroconductive layer retains a plurality of resin particles so that at least a part of each of the resin particles is exposed on the outer surface of the developing roller.

The "outer surface" of the developing roller means an abutment surface of the developing roller when the developing roller abuts with other members such as a toner supply roller, a toner control member, and an electrophotographic photosensitive member. The outer surface of the electroconductive layer refers to a surface of the electroconductive layer, the surface being opposite to a surface facing the substrate, and also includes any surface not exposed due to the presence of any electrically insulating domain.

The outer surface of the developing roller is constituted by electrically insulating domains and an electroconductive matrix. The electrically insulating domains are constituted by parts of the resin particles exposed on the outer surface of the developing roller. The electroconductive matrix is constituted by a part of the outer surface of the electroconductive layer. The resin particles are retained by the electroconductive layer.

When a square region 200-μm on a side is put on the outer surface of the developing roller so that one side of the square region is along a longitudinal direction of the developing roller, i.e. a direction parallel to an axial direction of the developing roller, the square region includes a plurality of the electrically insulating domains, and at least two electrically insulating domains among the plurality of the electrically insulating domains in the square region satisfy the following condition 1.

Condition 1: having an equivalent circle diameter of 10 μm or more and 80 or less respectively, and having an inter-wall distance therebetween of 10 μm or more and 100 μm or less.

The square region may be herein provided at one place arbitrarily selected, as long as one side thereof is along the longitudinal direction of the developing roller.

When a potential map of the square region is created as follows, the presence of each of the two electrically insulating domains satisfying the condition 1 is ascertained in the potential map.

Method of creating potential map: first, the outer surface of the developing roller where the square region is put is charged with a discharging wire disposed parallel to the longitudinal direction of the developing roller and at a location 2 mm away from the outer surface of the developing roller, by applying a direct voltage of −5 kV between the substrate and the discharge wire in an environment of a temperature of 23° C. and a relative humidity of 50%. Then, the square region is equally divided by 50 straight lines parallel to one side of the square region and 50 straight lines perpendicular to the straight lines, a potential at each point of intersection between those straight lines (2500 points in total) is measured with an electrical force microscope. By using values of the potential measured at the 2500 points, the potential map of the charged outer surface in the square region of the developing roller is created.

The above configuration allows the developing roller to be increased in developer conveyance ability. The present aspect is particularly suitable in the case of use of a non-magnetic one-component developer.

Figure 2:
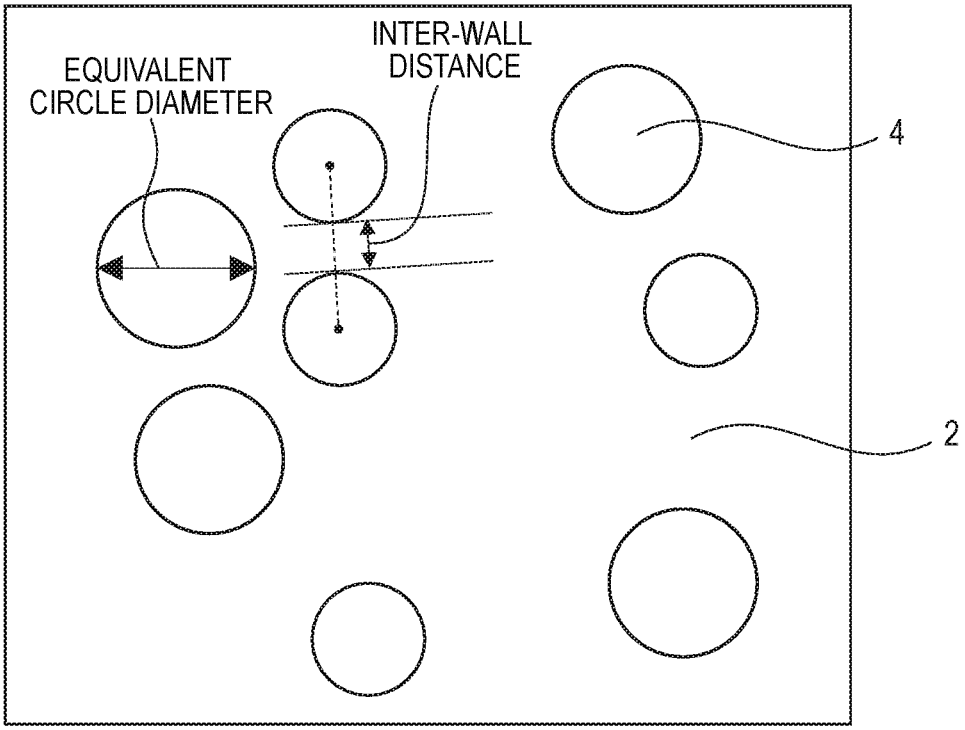
FIG. 2 includes a schematic view illustrating one example of the outer surface of a developing roller according to one aspect of the present disclosure.

FIG. 1 illustrates a schematic view of a cross section perpendicular to the longitudinal direction of a developing roller and FIG. 2 illustrates a schematic view of the outer surface of the developing roller, by way of example. The developing roller includes an electroconductive substrate 1 and an electroconductive layer 2 on the substrate 1. Spherical resin particles 3 are dispersed in the electroconductive layer 2. The electroconductive layer 2 retains a plurality of planar section-provided spherical resin particles 4 so that such resin particles are exposed on the outer surface of the developing roller. The "planar section-provided spherical resin particles" here mean spherical resin particles each having a planar section on the outer surface thereof. The planar section-provided spherical resin particles 4 each have a typically circular planar section obtained by partially grinding the spherical resin particles 3. Each of the planar sections of the planar section-provided spherical resin particles 4 serves as an electrically insulating domain.

FIG. 2 illustrates an inter-wall distance between the two electrically insulating domains satisfying the condition 1. The inter-wall distance means a shortest distance between respective outer edges of the two electrically insulating domains satisfying the condition 1.

Figure 3A:
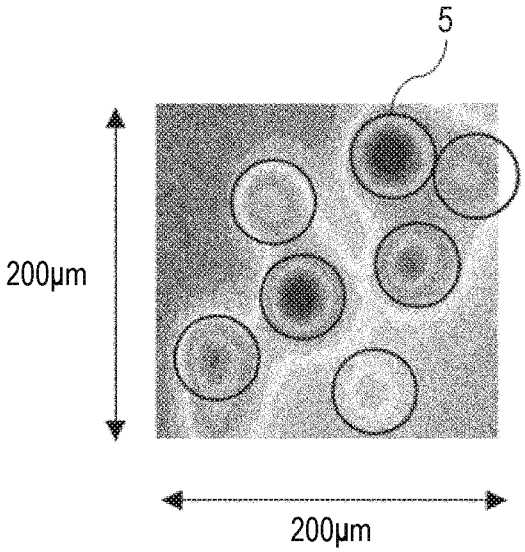
FIGS. 3A and 3B include observed images of the outer surface of a developing roller according to one aspect of the present disclosure.
Figure 3B:
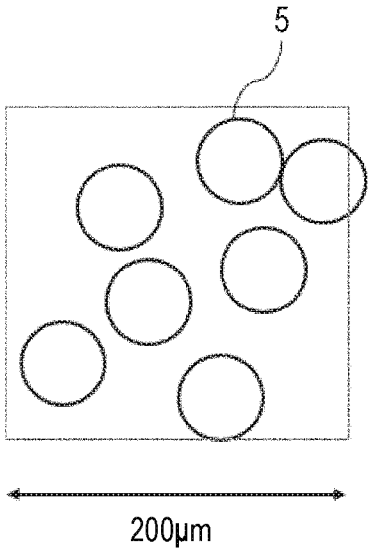

FIG. 3B illustrates a schematic view of an observed image of a square region 200-μm on a side which is put on the outer surface of a developing roller according to one aspect of the present disclosure so that the region includes any electrically insulating domain satisfying the condition 1, with an optical microscope. As illustrated in FIG. 3B, seven electrically insulating domains 5 in total are present in the square region. The electrically insulating domains mutually satisfy the condition 1.

FIG. 3A illustrates a potential map created by the aforementioned method. The presence of electrically insulating domains 5 in the potential map illustrated in FIG. 3A can be ascertained at the same locations as the locations of the electrically insulating domains 5 in the observed image with an optical microscope. In such a case, electric fields by adjacent electrically insulating domains are mutually affected to make the slopes of the electric fields precipitous, resulting in an increase in gradient force. As a result, the developer conveyance ability of the developing roller is increased.

Figure 4A:
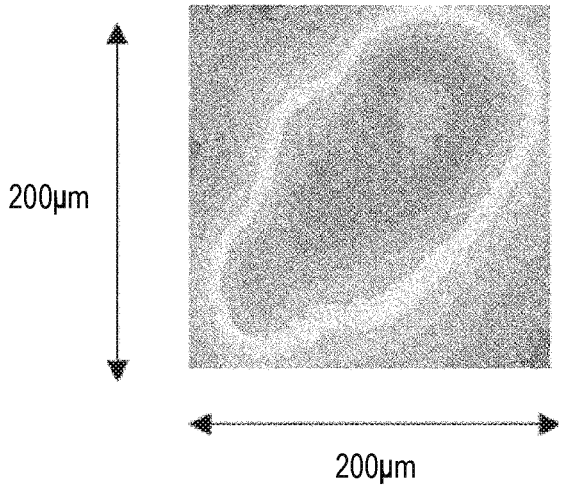
FIGS. 4A and 4B include observed images of the outer surface of a developing roller according to Comparative Examples.
Figure 4B:
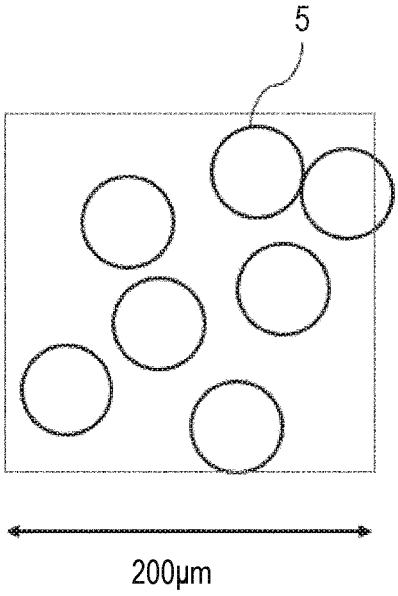

Next, FIG. 4B illustrates an observed image of a developing roller according to Comparative Examples, with an optical microscope. As in FIG. 3B, seven electrically insulating domains 5 in total are present in a 200-μm square region. The electrically insulating domains mutually satisfy the condition 1.

FIG. 4A illustrates a potential map created by charging the square region in a predetermined condition. Such seven electrically insulating domains cannot be confirmed on the potential map, and observation is made as if one electrically insulating domain is present. It is meant that the potential difference between the electrically insulating domains and the electroconductive matrix is small. In such a case, no gradient force acts on each of the electrically insulating domains, thereby not enabling each of the domains to carry a developer, and the amount of a developer which can be conveyed is reduced as compared with the amount in the developing roller according to FIG. 3A.

Hereinafter, the configuration of the developing roller according to the present aspect will be described in detail. The description is made with toner as an example of a developer.

[Electroconductive Substrate]

The shape of the electroconductive substrate used is preferably a columnar shape or a hollow cylindrical shape. The material of the electroconductive substrate is not limited as long as the material is an electroconductive material, and examples thereof include metals or alloys such as aluminum, a copper alloy, stainless steel and free-cutting steel, iron plated with chromium or nickel, and a synthetic resin having electro-conductivity. The surface of the electroconductive substrate may also be coated with an adhesive for the purpose of an enhancement in adhesiveness to the electroconductive layer to be provided on the outer periphery thereof

[Electroconductive Layer]

The electroconductive layer preferably has a volume resistivity of $10^3$ Ω·cm or more and $10^{11}$ Ω·cm or less so as to serve as the electroconductive matrix. When the volume resistivity of the electroconductive layer falls within the range, any charge sufficient for conveyance of toner is easily retained in the electrically insulating domains.

The electroconductive layer preferably includes at least a binder resin and includes an electroconductive particle dispersed in the binder resin, so as to be adjusted to have the volume resistivity. Examples of such an electroconductive particle include particles of metals such as Ni and Cu, particles of metal oxides such as tin oxide and zinc oxide, and carbon materials such as carbon black and carbon fiber. The electroconductive layer may include an electroconductive substance such as various ion conductive agents.

[Electrically Insulating Domain]

When a 200-μm square region is provided on the outer surface of the developing roller, as described above, at least two electrically insulating domains among a plurality of electrically insulating domains in the square region satisfy condition 1. The size of each of the at least two electrically insulating domains is 10 μm or more and 80 μm or less in terms of the equivalent circle diameter, as defined in the condition 1. When the size of each of the electrically insulating domains falls within the above range, the electrically insulating domains can be increased in the amount of charging and the electrically insulating domains can be increased in potential. As a result, the developing roller can be increased in toner conveyance ability.

The distance between the wall surfaces of the at least two electrically insulating domains is 10 μm or more and 100 μm or less. When the distance between the wall surfaces of such electrically insulating domains falls within the range, electric fields by the electrically insulating domains are mutually affected to make the slopes of the electric fields precipitous, resulting in an increase in gradient force and an increase in the ability of adsorption and conveyance of toner.

The ratio of the sum of the areas of the electrically insulating domains in the square region to the area of the square region preferably falls within the range of 5% or more and 50% or less. When the ratio of the sum of the areas of the electrically insulating domains falls within the range, the electrically insulating domains can have a sufficient amount of charge for adsorption and conveyance of toner.

The electrically insulating domains preferably have a volume resistivity of $10^{13}$ Ω·cm or more and $10^{18}$ Ω·m or less in terms of the volume resistance of any resin particles used. When the volume resistivity falls within the above range, a charged roller easily retains any charge sufficient for conveyance of toner.

[Resin Particles]

The resin particles preferably have electrically insulating properties, and preferably have a volume resistivity of $10^{13}$ Ω·cm or more and $10^{18}$ Ω·cm or less. Specific examples include acrylic resins such as a polymethyl methacrylate resin, a poly(butyl methacrylate) resin and a poly(acrylic acid) resin, a polystyrene resin, a silicone resin, a polybutadiene resin, a phenol resin, a nylon resin, a fluororesin, an epoxy resin, a polyester resin, and a urethane resin, and an acrylic resin or a polystyrene resin is preferably used. Such resin particles may be used singly or in combinations of two or more kinds thereof

[Binder Resin]

The binder resin included in the electroconductive layer, which can be appropriately used, is a binder resin which can impart rubber elasticity to the electroconductive layer in any range of the temperature of the developing roller actually used.

Specific examples include an acrylonitrile-butadiene copolymer (NBR), epichlorohydrin-containing rubbers such as an epichlorohydrin homopolymer (CO), an epichlorohydrin-ethylene oxide copolymer (ECO) and an epichlorohydrin-ethylene oxide-allyl glycidyl ether terpolymer (GECO), natural rubber (NR), isoprene rubber (IR), butadiene rubber (BR), styrene-butadiene rubber (SBR), butyl rubber (IIR), ethylene/propylene/diene terpolymer rubber (EPDM), a hydrogenated product of acrylonitrile-butadiene copolymer (H-NBR), thermosetting rubber materials including a crosslinking agent compounded to raw material rubber such as chloroprene rubber (CR) or acrylic rubber (ACM, ANM), and thermoplastic elastomers such as a polyolefin-based thermoplastic elastomer, a polystyrene-based thermoplastic elastomer, a polyester-based thermoplastic elastomer, a polyurethane-based thermoplastic elastomer, a polyamide-based thermoplastic elastomer and a polyvinyl chloride-based thermoplastic elastomer. Such binder resins may be used singly or in combinations of two or more kinds thereof.

An acrylonitrile-butadiene copolymer (NBR) and epichlorohydrin-containing rubber are preferably used from the viewpoint of processability, resistance adjustment and the like with respect to the developing roller.

[Kneading Method]

In order to produce the developing roller, first, the binder resin, the electroconductive particle, other additive, and the resin particles, serving as raw materials of the electroconductive layer, can be kneaded. The method for kneading such raw materials, which can be used, is a method using a closed kneader such as a Banbury mixer, an intermix or a pressure kneader, or a method using an open kneader such as an open roll.

In order that a plurality of electrically insulating domains each having an equivalent circle diameter in the range of 10 to 80 μm are located on the outer surface so that the inter-wall distance thereof ranges from 10 to 100 μm, it is effective to adjust the average particle size of resin particles in an unvulcanized rubber composition for electroconductive layer formation, and the content of the resin particles in the unvulcanized rubber composition (% by volume). Specifically, for example, the particle size of the resin particles is preferably 10 μm or more and 80 μm or less in terms of volume average particle size. The content of the resin particles in the unvulcanized rubber composition is preferably 2% by volume or more and 40% by volume or less.

[Molding Method]

A kneaded product obtained by the kneading can be molded onto the electroconductive substrate. Such a molding method which can be used is extrusion, injection molding, compression molding or the like. Crosshead extrusion which involves extruding a kneaded product to be formed into the electroconductive layer, together with the electroconductive substrate, is preferable in consideration of, for example, an increase in working efficiency. Thereafter, the kneaded product is preferably subjected to a crosslinking step such as crosslinking in a mold, crosslinking in a vulcanization can in a vulcanization can, continuous crosslinking, far- or near infrared crosslinking or induction heat crosslinking, when the binder resin needs to be crosslinked.

[Method for Exposing Resin Particles]

After molding, the resin particles can be ground and thus exposed from the electroconductive layer after molding. For example, an electroconductive layer can be obtained where planar section-provided spherical resin particles are retained so that at least a part of each of such planar sections is exposed on the outer surface of the developing roller. The grinding method which can be adopted is a traverse grinding mode or a plunge grinding mode. The traverse grinding mode is a method where grinding is performed by movement of a short grindstone to the surface of the roller, and on the contrary, the plunge grinding mode is a method where grinding is performed by use of a grindstone having a width more than the length of the electroconductive layer and sending of the grindstone in a radial direction of the grindstone. The plunge grinding mode is preferable in terms of a reduction in working time.

[Surface Treatment]

Even when at least two electrically insulating domains in the square region satisfy the condition 1, the presence of each of such two electrically insulating domains satisfying the condition 1 cannot be sometimes confirmed in the potential map.

A developing roller where a boundary between such electrically insulating domains and the electroconductive matrix is thus not clear in the potential map and such electrically insulating domains cannot be mutually distinguished has difficulty in generating the gradient force in each of such electrically insulating domains.

The reason why such electrically insulating domains satisfying the condition 1 cannot be distinguished in the potential map is because a sufficient potential difference cannot be generated between the electrically insulating domains and the electroconductive matrix in the case of charging of the surface of the developing roller.

The outer surface of the developing roller can be subjected to a surface treatment to thereby allow a sufficient potential difference to be generated between such two electrically insulating domains satisfying the condition 1 and the electroconductive matrix present therebetween, and as a result, two adjacent electrically insulating domains can be distinguished also in the potential map.

Examples of the surface treatment include irradiation with ultraviolet light and dry ice blasting. In the case of irradiation with ultraviolet light, the irradiation intensity preferably falls within the range of 1,000 mJ/cm$^2$ or more and 15,000 mJ/cm$^2$ or less in terms of sensitivity in a 254-nm sensor. The irradiation intensity of irradiation with ultraviolet light can be set within the above range, thereby allowing adjacent electrically insulating domains to be distinguished.

[Confirmation of Electrically Insulating Domain and Electroconductive Matrix]

Under the assumption that a 200-μm square region is provided on the outer surface of the developing roller so that one side thereof is along with the longitudinal direction of the developing roller, the presence of the electrically insulating domains and the electroconductive matrix in the square region, and whether a plurality of the electrically insulating domains satisfies condition 1 can be confirmed with an optical microscope or a scanning electron microscope.

Electrically insulating properties of an electrically insulating portion forming each of the electrically insulating domains and electroconductive properties of the electroconductive layer forming the electroconductive matrix can be evaluated by the volume resistivity and can also be evaluated by the potential decay time constant.

The potential decay time constant means a time taken for decaying of a residual potential to 1/e of the initial value, and serves as an index of ease of retention of a potential charged. Here, e represents a base of natural logarithm.

The potential decay time constant of the electrically insulating portion (electrically insulating domain) is preferably 1.0 minute or more because charging of the electrically insulating portion is rapidly performed and the potential due to such charging can be easily retained. The potential decay time constant of the electroconductive layer (electroconductive matrix) is preferably $1.0\times10^{-1}$ minute or less because charging of the electroconductive layer is suppressed, the potential difference with an electrically insulating portion charged is easily generated, and the gradient force is easily exhibited. When the residual potential is substantially 0 Vat the start of measurement of the potential decay time constant, namely, the potential is fully decayed at the start of the measurement, the time constant at the measurement point can be assumed to be less than $1.0\times10^{-1}$ minute.

[Measurement of Potential Map]

In order to create the potential map, first, at least a region of the outer surface of the developing roller to be measured, on which the square region is provided, is charged with a corona charger.

Specifically, a discharge wire is disposed so that not only the region of the developing roller is opposite to the discharge wire of the corona charger and the longitudinal direction of the discharge wire is perpendicular to the longitudinal direction of the developing roller, but also the discharge wire is disposed at a distance of 2 mm from the surface of the developing roller. A direct voltage of −5 kV is then applied between the substrate of the developing roller and the discharge wire, with the developing roller being moved in the longitudinal direction thereof at a speed of 20 mm/s, thereby allowing the region of the outer surface of the developing roller to be charged, in an environment of a temperature of 23° C. and a relative humidity of 50%.

Thereafter, the region of the outer surface of the developing roller is equally divided by 50 straight lines parallel to one side of the region and 50 straight lines perpendicular to the straight lines, and the potential is measured at each point of intersection of such straight lines. For example, an electrical force microscope (trade name: MODEL 110TN, manufactured by Trek Japan) can be used for potential measurement. A potential map is created based on the potential measured.

[Measurement of Potential Decay Time Constant]

The potential decay time constant τ can be determined by charging the outer surface of the developing roller by a corona charger, measuring the residual potential with time, on the electrically insulating portion (electrically insulating domain) or the electroconductive layer (electroconductive matrix) present on the outer surface, and fitting the measurement value to the following expression (1). An electrical force microscope (trade name: MODEL 1100TN, manufactured by Trek Japan) can be here used.

$$V_0=V(t)\times\exp(-t/\tau) \quad (1)$$

t: lapse time (sec) after passing of measurement point immediately below corona charger;

$V_0$: initial potential (potential at t=0 seconds) (V);

V(t): residual potential (V) at t second(s) after passing of measurement point through corona charger;

τ: potential decay time constant (sec).

[Electrophotographic Image Forming Apparatus and Electrophotographic Process Cartridge]

The electrophotographic image forming apparatus can include a photosensitive member as an electrostatic latent image carrier that forms and carries an electrostatic latent image, a charging apparatus that charges the photosensitive member, and an exposure apparatus that forms an electrostatic latent image on the photosensitive member charged. The electrophotographic image forming apparatus can further include a developing apparatus including a developing roller, which develops the electrostatic latent image by toner, thereby forming a toner image, and a transfer apparatus that transfers the toner image to a transfer material.

Figure 5:
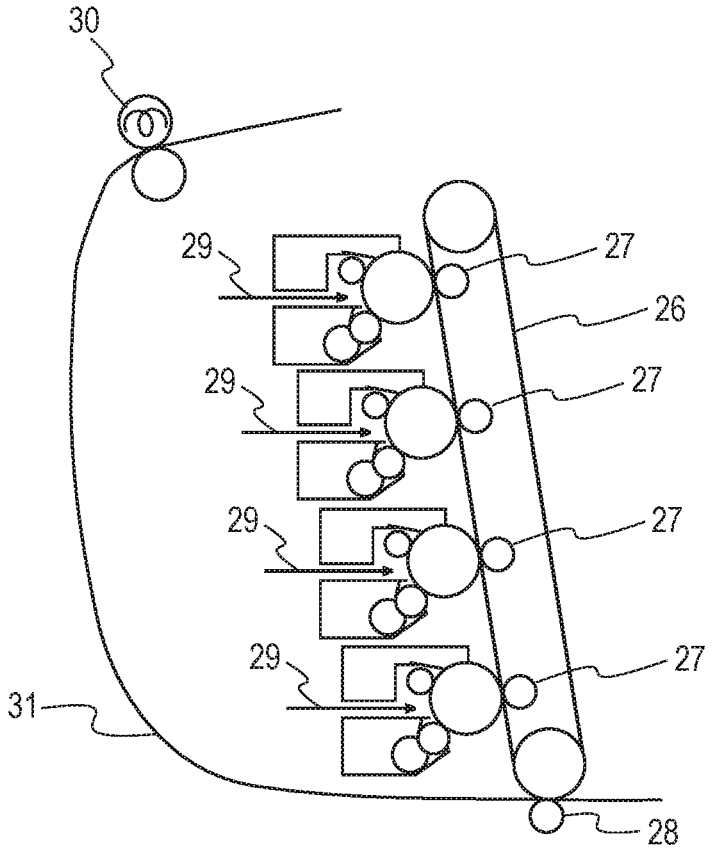
FIG. 5 includes a schematic configuration diagram illustrating one example of an electrophotographic image forming apparatus according to one aspect of the present disclosure.
Figure 6:
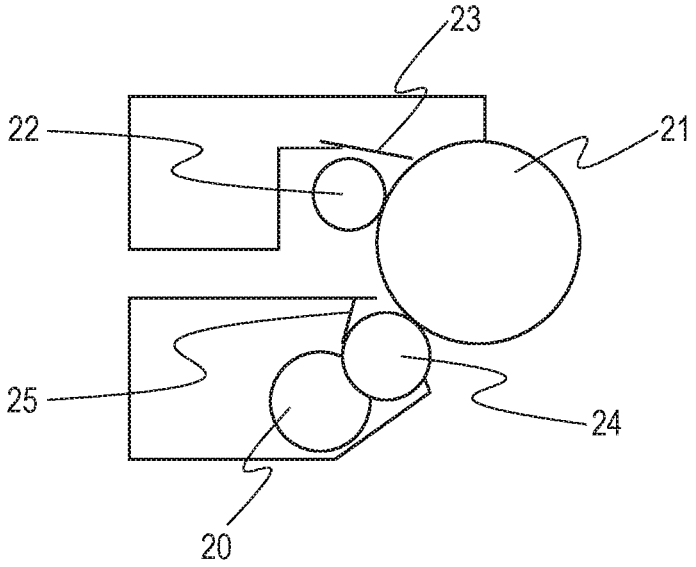
FIG. 6 includes a schematic configuration diagram illustrating one example of an electrophotographic process cartridge according to one aspect of the present disclosure.

FIG. 5 schematically illustrates one example an electrophotographic image forming apparatus according to one aspect of the present disclosure. FIG. 6 schematically illustrates an electrophotographic process cartridge to be mounted to the electrophotographic image forming apparatus of FIG. 5. The electrophotographic process cartridge includes a photosensitive member 21, and a charging apparatus provided with a charging member 22, a developing apparatus provided with a developing roller 24 and a cleaning apparatus provided with a cleaning member 23. The electrophotographic process cartridge is configured so as to be detachably attachable to the main body of the electrophotographic image forming apparatus of FIG. 5.

The photosensitive member 21 is evenly charged (primarily charged) by the charging member 22 connected to a bias power source not illustrated. The charged potential of the photosensitive member is here, for example, −800 V or more and −400 V or less. Next, the photosensitive member is irradiated with exposure light 29 that allows an electrostatic latent image to be written, by an exposure apparatus not illustrated, and an electrostatic latent image is formed on the surface of the photosensitive member. Any of LED light and laser light can be used for such exposure light. The surface potential of a portion of the photosensitive member, exposed, is, for example, −200 V or more and −100 V or less.

Next, the toner negatively charged by the developing roller 24 is provided (developed) to the electrostatic latent image, a toner image is formed on the photosensitive member, and the electrostatic latent image is transformed to a visible image. A voltage of, for example, −500 V or more and −300 V or less is here applied to the developing roller by a bias power source not illustrated. The developing roller is in contact with the photosensitive member with a nip width of, for example, 0.5 mm or more and 3 mm or less. The toner supply roller 20 is allowed to rotatably abut on a developing member, upstream of the rotation of the developing roller relative to an abutment portion between the toner control member 25 and the developing roller 24.

The toner image developed on the photosensitive member is primarily transferred to an intermediate transfer belt 26. A primary transfer member 27 abuts on the rear surface of the intermediate transfer belt, and a voltage of, for example, +100 V or more and +1500 V or less is applied to the primary transfer member, thereby primarily transferring the toner image negatively charged, from an image carrier to the intermediate transfer belt. The primary transfer member may have a roller shape or a blade shape.

When the electrophotographic image forming apparatus is a full-color image forming apparatus, each of the steps of charging, exposing, developing and primarily transferring is performed with respect to each of yellow, cyan, magenta and black colors. In order to perform such steps, an electrophotographic image forming apparatus illustrated in FIG. 5 includes one electrophotographic process cartridge including toner of each of the colors therein, namely, four of such electrophotographic process cartridges in total, mounted to the main body of the electrophotographic image forming apparatus so as to be detachably attachable thereto. Each of the steps of charging, exposing, developing and primarily transferring is sequentially performed with a predetermined time lag, thereby generating a state where toner images of four colors, for presenting a full-color image, are overlapped with one another on the intermediate transfer belt.

Such toner images on the intermediate transfer belt 26 are conveyed to a place opposite to a secondary transfer member 28 according to rotation of the intermediate transfer belt. A recording sheet is continuously conveyed between the intermediate transfer belt and the secondary transfer member along with a conveyance route 31 of the recording sheet at a predetermined timing, and the toner images on the intermediate transfer belt is transferred onto the recording sheet by application of a secondary transfer bias to the secondary transfer member. The bias voltage here applied to the secondary transfer member is, for example, +1000 V or more and +4000 V or less. The recording sheet onto which the toner images are transferred by the secondary transfer member is conveyed to a fixing apparatus 30, the toner images on the recording sheet are molten and fixed to the recording sheet, and thereafter the recording sheet is discharged out of the electrophotographic image forming apparatus, resulting in completion of a printing operation.

According to one aspect of the present disclosure, a developing roller which is high in developer conveyance ability and which enables a high-quality electrophotographic image to be formed can be provided. According to another aspect of the present disclosure, an electrophotographic process cartridge which contributes to formation of a high-quality electrophotographic image can be provided. According to still another aspect of the present disclosure, an electrophotographic image forming apparatus which enables a high-quality electrophotographic image to be formed can be provided.

EXAMPLES

Hereinafter, the developing roller according to the present aspect will be described in more detail with reference to specific Examples, but the configuration of the developing roller according to the present disclosure is not intended to be limited to any configuration embodied in such Examples.

Example 1

[Preparation of Unvulcanized Rubber Composition for Electroconductive Layer]

Materials shown in Table 1 below were mixed by use of a 6-L pressure kneader (trade name: TD6-15MDX, manufactured by Toshinsha Co., Ltd.) at a rate of filling of 70% by volume and a rotational speed of a blade of 30 rpm for 16 minutes, thereby providing an A-kneaded rubber composition.

TABLE 1

| | | |
|---|---|---|
| NBR | Trade name: NIPOL DN225 manufactured by Zeon Corporation | 100 parts by mass |
| | Zinc stearate | 1 parts by mass |
| | Zinc oxide | 5 parts by mass |
| | Calcium carbonate | 30 parts by mass |
| Carbon black | Trade name: Toka Black #5500 manufactured by Tokai Carbon Co., Ltd. | 25 parts by mass |
| Resin particle No. 1 | Polymethyl methacrylate resin particle (trade name: Techpolymer MBX-30; manufactured by Sekisui Plastics Co., Ltd., particle size: 30 μm | 15 parts by mass |

Next, materials shown in Table 2 below were bilaterally cut 20 times in total by an open roll having a roll diameter of 12 inches at a rotational speed of a front roll of 10 rpm, a rotational speed of a back roll of 8 rpm and a roll interval of 2 mm. Thereafter, the resultant was subjected to tight milling 10 times at a roll interval of 0.5 mm, thereby providing an unvulcanized rubber composition for an electroconductive layer.

The content on a volume basis of resin particle No. 1 in the unvulcanized rubber composition was 8.4% by volume.

TABLE 2

| | | |
|---|---|---|
| A-kneaded rubber composition obtained above | | 176 parts by mass |
| | Sulfur | 1.2 parts by mass |
| Vulcanization accelerator | Tetrabenzylthiuram disulfide, trade name: PERKACIT-TBzTD, manufactured by FLEXSYS | 4.5 parts by mass |

[Production of Developing Roller]

A columnar electroconductive core having a diameter of 6 mm and a length of 252 mm (made of steel, the surface was plated with nickel) was prepared. A center section in the axis direction of the columnar surface of the core, corresponding to 226 mm, was coated with an electroconductive vulcanized adhesive (trade name: Metaloc U-20, manufactured by Toyokagaku Kenkyusho Co., Ltd.), and dried at 80° C. for 30 minutes. In the present Example, the columnar electroconductive core coated with the adhesive was used as an electroconductive substrate.

Next, the unvulcanized rubber composition was concentrically and cylindrically extruded by extrusion using a crosshead, with the electroconductive substrate as the center, thereby producing an unvulcanized rubber roller having a diameter of 7.8 mm with the periphery of the electroconductive substrate being coated with the unvulcanized rubber composition. The extruder used was an extruder having a cylinder diameter of 45 mm (Φ45) and a ratio of L/D of 20, and the temperatures of the head, the cylinder and the screw in the extrusion were 90° C., 90° C. and 90° C., respectively. Both ends of the unvulcanized rubber roller formed were cut to allow the width in the axis direction of the section of the unvulcanized rubber composition to be 228 mm, and thereafter the resultant was subjected to a heat treatment in an electric furnace at 160° C. for 40 minutes, thereby providing a vulcanized rubber roller.

The vulcanized rubber roller was ground by a plunge grinding machine, thereby providing a ground rubber roller including a crown-shaped electroconductive layer (elastic layer) having an end diameter of 7.35 mm and a center diameter of 7.50 mm. A plunge grinding machine (trade name: LEO-600E-F4L-BME, CNC grinding machine exclusively used for rubber roll, manufactured by Minakuchi Machinery Works Ltd.) was here used. A grindstone (trade name: Grinding Wheel GC-60-B-VRG-PM, manufactured by Noritake Co., Ltd.) was used and conditions were as follows: the rotational speed of the grindstone: 2800 rpm, the rotational speed of the roller: 333 rpm, and the speed of grinding relative to the diameter of the unvulcanized rubber roller: 30 mm/min.

The ground rubber roller was subjected to a surface treatment with ultraviolet light. Specifically, the outer surface thereof was uniformly irradiated with ultraviolet light by use of a low-pressure mercury lamp (trade name: GLQ500US/11, manufactured by Harison Toshiba Lighting Corporation) with the ground rubber roller being rotated, thereby providing a developing roller. The amount of ultraviolet light was 4,000 mJ/cm$^2$ in terms of sensitivity in a 254-nm sensor.

[Optical Microscope Observation, and Measurement of Equivalent Circle Diameter and Inter-Wall Distance]

The electrically insulating domain can be distinguished with an optical microscope based on the difference in surface form from the electroconductive layer (electroconductive matrix). An optical microscope (trade name: DIGITAL MICROSCOPE VHX-5000, manufactured by Keyence Corporation) was used to observe the outer surface of the developing roller produced, at a magnification of ×300.

A plurality of electrically insulating domains and an electroconductive matrix formed from a part of the outer surface of the electroconductive layer were confirmed by the observation. It was also confirmed in the observation that, when a 200-μm square region was provided on the outer surface of the developing roller so that one side of the square region was along with the longitudinal direction of the developing roller, two electrically insulating domains satisfying condition 1 were present in the square region. The equivalent circle diameters of such two (first and second) electrically insulating domains and the inter-wall distance of such two electrically insulating domains were determined.

The area ratio of the electrically insulating domains to the square region was calculated by dividing the sum of the areas of the electrically insulating domains in the square region by the area of the square region. The square region was observed at nine points of three points in the longitudinal direction×three points in the circumferential direction, of the outer surface of the developing roller, and the average of the values at the nine points was defined as the area ratio of the electrically insulating domains to the square region. The measurement results are shown in Table 3.

[Measurement of Volume Resistivity of Electroconductive Layer]

A sample including the electroconductive layer was cut out from the developing roller produced, and a thin piece sample having a plane surface size of 50-μm square and a thickness T of 100 nm was produced by a microtome. Next, the thin piece sample was placed on a metal plate, and a metal terminal having an area S of a pushing surface of 100 $\mu m^2$ was pushed onto the electroconductive layer of the thin piece sample from above. A voltage of 1 V was applied, in such a state, between the metal terminal and the metal plate by "Electrometer 6517B" (trade name) manufactured by Keithley Instruments, thereby allowing the resistance R to be determined. The volume resistivity pv Ω·cm) was calculated from the resistance R according to the following expression.

$$pv=R\times S/T$$

Three samples were subjected to the same operation, and the 3-point arithmetic average of the volume resistivity pv was determined. The resulting volume resistivity was here $4\times10^5$ Ω·cm.

[Measurement of Volume Resistivity of Resin Particles]

A sample including the resin particles was cut out from the developing roller produced, and a thin piece sample having a plane surface size of 50-μm square and a thickness T of 100 nm was produced by a microtome. The volume resistivity (3-point arithmetic average) of the resin particles was determined in the same manner as in the measurement of the volume resistivity of the electroconductive layer. The resulting volume resistivity was here $4\times10^{15}$ Ω·cm.

[Measurement of Potential Decay Time Constant]

The potential decay time constant was determined by charging the outer surface of the developing roller by a corona charger, and measuring the respective residual potentials on the electrically insulating portion (electrically insulating domain) and the electroconductive layer (electroconductive matrix) present on the outer surface with time by an electrical force microscope. An electrical force microscope (trade name: MODEL 1100TN, manufactured by Trek Japan) was here used. The measurement value was fitted to the expression (1), thereby determining the potential decay time constant.

Specifically, the developing roller produced was first left to still stand in an environment of a room temperature of 23° C. and a relative humidity of 50% for 24 hours. Subsequently, the developing roller was placed on a high-accuracy XY stage incorporated to the electrical force microscope, in the same environment. The corona charger here used was one where the distance between a discharge wire and a grid electrode was 8 mm. The developing roller was disposed so that the longitudinal direction thereof was perpendicular to the longitudinal direction of the discharge wire and the distance between the grid electrode of the corona charger and the outer surface of the developing roller was 2 mm. Next, the developing roller was grounded, and a voltage of −5 kV was applied to the discharge wire and a voltage of −0.5 kV was applied to the grid electrode by use of an external power source. After the start of application, the developing roller was moved in the longitudinal direction thereof at a speed of 20 mm/s by use of the high-accuracy XY stage and the developing roller was allowed to pass immediately below the corona charger, thereby charging the outer surface of the developing roller.

Subsequently, the high-accuracy XY stage was used to move the measurement point immediately below the cantilever of the electrical force microscope, and the residual potential with time was measured. An electrical force microscope was used for the measurement. The measurement conditions are shown below.

Measurement environment: temperature: 23° C., relative humidity: 50%;

Time from passing of measurement point immediately below corona charger to the start of measurement: 15 seconds;

Cantilever: trade name "cantilever for Model 1100TN" (Model number; Model 1100TNC-N, manufactured by Trek Japan);

Gap between measurement surface and cantilever tip: 10 μm;

Measurement frequency: 6.25 Hz;

Measurement time: 1000 seconds.

The respective potential decay time constants τ of the electrically insulating domains and the electroconductive matrix were each measured at nine points of three points in the longitudinal direction×three points in the circumferential direction, of the outer surface of the developing roller, and the average of the values at the nine points was defined as the potential decay time constant of the electrically insulating domains or the electroconductive matrix. When a measurement point at which the residual potential was substantially 0 V at the start of measurement, namely, at 15 seconds after corona discharge was included with respect to measurement of the electroconductive matrix, the time constant was determined by calculating the average of the time constants at the residual measurement points. When the potential was substantially 0 V at all the measurement points at the start of measurement, the time constant was considered to be less than 6.0 seconds (accordingly, the following Rating β). Rating was made according to the following criteria.

Rating α: potential decay time constant was 60.0 seconds or more.

Rating β: potential decay time constant was 6.0 seconds or less.

[Confirmation of Electrically Insulating Domains Satisfying Condition 1, on Potential Map]

The 200-μm square region of the outer surface of the developing roller, subjected to the optical microscope observation, was charged by the above method, and a potential map was thus created. The potential map was gray-scale displayed every 0.2 V, whether two electrically insulating domains satisfying condition 1, which were observed with the optical microscope and were present in the region, could be confirmed to be separated even on the potential map was observed, and rating was made according to the following criteria. The results are shown in Table 3.

Rank A: two electrically insulating domains satisfying condition 1 could be confirmed to be separated.

Rank B: two electrically insulating domains satisfying condition 1 could not be confirmed to be separated.

[Evaluation of Roughness of Image and Evaluation of Amount of Toner Conveyed]

First, a toner supply roller was removed from a process cartridge for magenta, of an electrophotographic image forming apparatus (trade name: Color Laser Jet Pro M452dw, manufactured by HP Development Company, L.P.). Thus, the amount of toner supplied to the developing roller was decreased. Next, the developing roller produced was mounted as the developing roller of the process cartridge, and left to still stand in an environment of a temperature of 30° C. and a relative humidity of 80% for 24 hours. Next, a solid image was continuously output for 10 sheets at a rate of 28 A4-sheets/min in the same environment, and the $10^{-th}$ image was evaluated with respect to the roughness thereof. The roughness of the image was rated according to the following criteria. The results are shown in Table 3.

Rank A: No roughness was seen on the image at all, and the image was smooth.

Rank B: Roughness was not significantly seen on the image.

Rank C: Roughness was slightly seen on the image.

Rank D: Roughness was seen on the image.

Subsequently, the output operation was stopped in outputting of the solid image for one sheet, the developing roller was removed, and the amount of a developer attached onto the developing roller was measured. The region subjected to such measurement was a region between a place which abutted on the photosensitive member and a place which abutted on a toner control member, at the stopping of the output operation. The measurement method included suctioning toner by use of a nozzle for suction, having an opening having a diameter of Φ5 mm, and measuring the mass of the toner suctioned and the area of the region subjected to such suction, to determine the amount of the toner conveyed (mg/cm$^2$), and the amount was rated according to the following criteria. The results are shown in Table 3.

Rank A: 1.20 mg/cm$^2$ or more.

Rank B: 0.80 mg/cm$^2$ or more and less than 1.20 mg/cm$^2$.

Rank C: 0.40 mg/cm$^2$ or more and less than 0.80 mg/cm$^2$.

Rank D: less than 0.40 mg/cm$^2$.

Examples 2 to 6

Each developing roller was produced and evaluated in the same manner as in Example 1 except that at least one of the type and the amount of the resin particles added was changed as described in Table 3.

The details of resin particles Nos. 2 to 6 shown in Table 3 are shown in Table 4.

Examples 7 to 10

Each developing roller was produced and evaluated in the same manner as in Example 1 except that the amount of light in the ultraviolet treatment as the surface treatment was changed as shown in Table 3.

Comparative Example 1

A developing roller was produced and evaluated in the same manner as in Example 1 except that no surface treatment was performed.

Comparative Examples 2 to 3

Each developing roller was produced and evaluated in the same manner as in Example 1 except that the type and the amount of the resin particles added were changed as shown in Table 3.

Comparative Examples 4 to 5

Each developing roller was produced and evaluated in the same manner as in Example 1 except that the amount of light in the ultraviolet treatment as the surface treatment was changed as shown in Table 3.

The foregoing results are summarized in Table 3. It was confirmed with an optical microscope also in Examples 2 to 10 and Comparative Examples 1 to 5 that a plurality of electrically insulating domains and an electroconductive matrix were observed on the outer surface of the developing roller and two electrically insulating domains satisfying condition 1 were included in the square region, as in Example 1.

TABLE 3

| | | Resin particle | | Volume resistivity | | Time constant τ | | Electrically insulating domain | |
|---|---|---|---|---|---|---|---|---|---|
| | | | Number of parts (parts by mass) | Electro-conductive layer (Ω · cm) | Spherical resin particle (Ω · cm) | Electro-conductive matrix | Electrically insulating domain | Equivalent circle diameter (μm) First | Equivalent circle diameter (μm) Second |
| Examples | 1 | 1 | 15 | $4 \times 10^5$ | $4 \times 10^{15}$ | β | α | 28.1 | 37.5 |
| | 2 | 2 | 15 | $5 \times 10^5$ | $9 \times 10^{15}$ | β | α | 12.6 | 12.8 |

TABLE 3-continued

| | | | | | | | | | |
|---|---|---|---|---|---|---|---|---|---|
| | 3 | 3 | 15 | $4 \times 10^5$ | $8 \times 10^{15}$ | β | α | 50.2 | 55.6 |
| | 4 | 4 | 15 | $3 \times 10^5$ | $3 \times 10^{16}$ | β | α | 75.6 | 79.8 |
| | 5 | 1 | 30 | $5 \times 10^5$ | $4 \times 10^{15}$ | β | α | 27.3 | 32.5 |
| | 6 | 1 | 50 | $6 \times 10^5$ | $7 \times 10^{15}$ | β | α | 48.9 | 52.4 |
| | 7 | 1 | 15 | $8 \times 10^6$ | $8 \times 10^{15}$ | β | α | 26.9 | 36.6 |
| | 8 | 1 | 15 | $4 \times 10^6$ | $5 \times 10^{15}$ | β | α | 27.8 | 38.1 |
| | 9 | 1 | 15 | $9 \times 10^4$ | $5 \times 10^{15}$ | β | α | 25.6 | 36.7 |
| | 10 | 1 | 15 | $6 \times 10^4$ | $2 \times 10^{14}$ | β | α | 26.1 | 40.2 |
| Comparative Examples | 1 | 1 | 15 | $9 \times 10^6$ | $3 \times 10^{16}$ | β | α | 28.1 | 37.5 |
| | 2 | 5 | 10 | $4 \times 10^5$ | $2 \times 10^{14}$ | β | α | 6.8 | 7.7 |
| | 3 | 6 | 15 | $4 \times 10^5$ | $3 \times 10^{16}$ | β | α | 95.2 | 99.7 |
| | 4 | 1 | 15 | $9 \times 10^6$ | $1 \times 10^{16}$ | β | α | 25.5 | 36.9 |
| | 5 | 1 | 15 | $2 \times 10^4$ | $7 \times 10^{13}$ | β | α | 23.5 | 30.7 |

| | | Inter-wall distance (μm) | Area ratio (%) | Surface treatment: Ultraviolet treatment | Surface treatment: Irradiation intensity (mJ/cm2) | Potential mapping | Amount of toner to be conveyed ($mg/cm^2$) | | Rating of image |
|---|---|---|---|---|---|---|---|---|---|
| Examples | 1 | 65.7 | 8.9 | Yes | 4,000 | A | 0.82 | B | A |
| | 2 | 16.2 | 8.8 | Yes | 4,000 | A | 0.55 | C | A |
| | 3 | 60.5 | 9.6 | Yes | 4,000 | A | 1.25 | A | A |
| | 4 | 64.3 | 9.1 | Yes | 4,000 | A | 1.05 | B | A |
| | 5 | 25.8 | 14.2 | Yes | 4,000 | A | 1.28 | A | A |
| | 6 | 20.4 | 19.9 | Yes | 4,000 | A | 1.02 | B | A |
| | 7 | 45.2 | 8.7 | Yes | 1,200 | A | 0.79 | C | A |
| | 8 | 58.9 | 8.8 | Yes | 2,000 | A | 1.24 | A | A |
| | 9 | 63.3 | 8.1 | Yes | 8,000 | A | 0.96 | B | A |
| | 10 | 58.5 | 8.3 | Yes | 14,400 | A | 0.58 | C | A |
| Comparative Examples | 1 | 65.7 | 8.9 | No | — | B | 0.29 | D | D |
| | 2 | 12.2 | 6.9 | Yes | 4,000 | B | 0.32 | D | D |
| | 3 | 125.3 | 9.2 | Yes | 4,000 | B | 0.31 | D | D |
| | 4 | 55.9 | 8.6 | Yes | 500 | B | 0.36 | D | D |
| | 5 | 50.3 | 8.6 | Yes | 16,000 | B | 0.33 | D | D |

TABLE 4

| Resin particle No. | Material: Material name | Particle size (μm) |
|---|---|---|
| 1 | Polymethyl methacrylate resin particle (trade name: Techpolymer MBX-30, manufactured by Sekisui Plastics Co., Ltd.) | 30 |
| 2 | Polystyrene resin particle (trade name: Techpolymer SBX-12, manufactured by Sekisui Plastics Co., Ltd.) | 12 |
| 3 | Acrylic resin particle (trade name: Techpolymer MBX-50, manufactured by Sekisui Plastics Co., Ltd.) | 50 |
| 4 | Acrylic resin particle (trade name: Taftic AR650ML, white, manufactured by Toyobo Co., Ltd.) | 80 |
| 5 | Acrylic resin particle (trade name: Techpolymer MBX-8, manufactured by Sekisui Plastics Co., Ltd.) | 8 |
| 6 | Acrylic resin particle (trade name: Taftic AR650L, white, manufactured by Toyobo Co., Ltd.) | 100 |

It was found as shown in Table 3 that the developing roller of Examples had a high toner conveyance ability.

It was considered with respect to Comparative Example 1 that no surface treatment was performed to thereby cause the boundary between the electrically insulating domains and the electroconductive matrix to be unclear on the potential map, thereby making the electrically insulating domains mutually indistinguishable to result in a reduction in toner conveyance ability.

In Comparative Example 2, the electrically insulating domains, formed from the planar sections of the planar section-provided spherical resin particles exposed on the outer surface of the developing roller, had an equivalent circle diameter of less than 10 μm, resulting in a low toner conveyance ability. The reason was considered because the electrically insulating domains were so small in size that the amount of the electrically insulating domains charged was lacked.

In Comparative Example 3, the electrically insulating domains had an equivalent circle diameter of more than 80 μm and roughness was caused on the image. The reason could be described because the electrically insulating domains had an equivalent circle diameter of more than 80 μm and thus any image failure due to the electrically insulating domains could be identified on the image.

It was considered with respect to Comparative Example 4 that the amount of light in the ultraviolet treatment was 500 $mJ/cm^2$ to result in a low surface treatment strength and an unclear boundary between the electrically insulating domains and the electroconductive matrix on the potential map, thereby making the electrically insulating domains mutually indistinguishable to result in a reduction in toner conveyance ability.

It was considered with respect to Comparative Example 5 that the amount of light in the ultraviolet treatment was 16,000 $mJ/cm^2$ to thereby cause the electrically insulating domains to be strongly hydrophilized due to irradiation with ultraviolet light to result in a reduction in resistance, thereby making the electrically insulating domains mutually indistinguishable to result in a reduction in toner conveyance ability.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-163166, filed Aug. 31, 2018, which is hereby incorporated by reference herein in its entirety.

What is claimed is:

1. A developing roller comprising:

an electroconductive substrate; and an electroconductive layer on the substrate, wherein the electroconductive layer retains resin particles so that at least a part of each of the resin particles is exposed on an outer surface of the developing roller, the outer surface of the developing roller is constituted by electrically insulating domains, and an electroconductive matrix, each of the electrically insulating domains being constituted by the part of each of the resin particles exposed on the outer surface of the developing roller, and the electroconductive matrix being a part of an outer surface of the electroconductive layer, wherein assuming that a square region 200-μm on a side is put on the outer surface of the developing roller so that one side of the square region is along a longitudinal direction of the developing roller, the square region includes a plurality of the electrically insulating domains, and at least two electrically insulating domains among the plurality of the electrically insulating domains in the square region satisfy the following condition 1, Condition 1: having an equivalent circle diameter of 10 μm or more and 80 μm or less respectively, and having an inter-wall distance therebetween of 10 μm or more and 100 μm or less; and wherein assuming that the outer surface of the developing roller where the square region is put is charged with a discharging wire disposed parallel to the longitudinal direction of the developing roller and at a location 2 mm away from the outer surface of the developing roller, by applying a direct voltage of −5 kV between the substrate and the discharge wire in an environment of a temperature of 23° C. and a relative humidity of 50%, and assuming that the square region is equally divided by 50 straight lines parallel to one side of the square region and 50 straight lines perpendicular to the straight lines, a potential at each point of intersection between those straight lines with an electrical force microscope is measured, and a potential map of the charged outer surface of the developing roller on which the square region is put, is created, the presence of each of the two electrically insulating domains satisfying the condition 1, is ascertained in the potential map.

2. The developing roller according to claim 1, wherein the resin particles has a volume resistivity of $10^{13}$ Ω·cm or more and $10^{18}$ Ω·cm or less.

3. The developing roller according to claim 1, wherein the electroconductive layer has a volume resistivity of $10^{3}$ Ω·cm or more and $10^{11}$ Ω·cm or less.

4. The developing roller according to claim 1, wherein the electrically insulating domains have a potential decay time constant of 1.0 minute or more.

5. The developing roller according to claim 1, wherein the electroconductive matrix has a potential decay time constant of $1.0\times10^{1}$ minutes or less.

6. The developing roller according to claim 1, wherein a ratio of a sum of areas of the electrically insulating domains in the square region to an area of the square region is 5% or more and 50% or less.

7. The developing roller according to claim 1, wherein the resin particles comprises an acrylic resin or a polystyrene resin.

8. The developing roller according to claim 1, wherein the electroconductive layer comprises a binder resin and an electroconductive particle dispersed in the binder resin.

9. The developing roller according to claim 8, wherein the binder resin comprises rubber containing an acrylonitrile-butadiene copolymer or epichlorohydrin.

10. An electrophotographic process cartridge detachably attachable to a main body of an electrophotographic image forming apparatus, comprising a developing roller, wherein the developing roller comprises:

an electroconductive substrate; and an electroconductive layer on the substrate, wherein the electroconductive layer retains resin particles so that at least a part of each of the resin particles is exposed on an outer surface of the developing roller, the outer surface of the developing roller is constituted by electrically insulating domains, and an electroconductive matrix, each of the electrically insulating domains being constituted by the part of each of the resin particles exposed on the outer surface of the developing roller, and the electroconductive matrix being a part of an outer surface of the electroconductive layer, wherein assuming that a square region 200-μm on a side is put on the outer surface of the developing roller so that one side of the square region is along a longitudinal direction of the developing roller, the square region includes a plurality of the electrically insulating domains, and at least two electrically insulating domains among the plurality of the electrically insulating domains in the square region satisfy the following condition 1, Condition 1: having an equivalent circle diameter of 10 μm or more and 80 μm or less respectively, and having an inter-wall distance therebetween of 10 μm or more and 100 μm or less; and wherein assuming that the outer surface of the developing roller where the square region is put is charged with a discharging wire disposed parallel to the longitudinal direction of the developing roller and at a location 2 mm away from the outer surface of the developing roller, by applying a direct voltage of −5 kV between the substrate and the discharge wire in an environment of a temperature of 23° C. and a relative humidity of 50%, and assuming that the square region is equally divided by 50 straight lines parallel to one side of the square region and 50 straight lines perpendicular to the straight lines, a potential at each point of intersection between those straight lines with an electrical force microscope is measured, and a potential map of the charged outer surface of the developing roller on which the square region is put, is created, the presence of each of the two electrically insulating domains satisfying the condition 1, is ascertained in the potential map.

11. An electrophotographic image forming apparatus comprising a developing roller, wherein the developing roller comprises:

an electroconductive substrate; and an electroconductive layer on the substrate, wherein the electroconductive layer retains resin particles so that at least a part of each of the resin particles is exposed on an outer surface of the developing roller, the outer surface of the developing roller is constituted by electrically insulating domains, and an electroconductive matrix, each of the electrically insulating domains being constituted by the part of each of the resin particles exposed on the outer surface of the developing roller, and the electroconductive matrix being a part of an outer surface of the electroconductive layer, wherein assuming that a square region 200-μm on a side is put on the outer surface of the developing roller so that one side of the square region is along a longitudinal direction of the developing roller, the square region includes a plurality of the electrically insulating domains, and at least two electrically insulating domains among the plurality of the electrically insulating domains in the square region satisfy the following condition 1, Condition 1: having an equivalent circle diameter of 10 μm or more and 80 μm or less respectively, and having an inter-wall distance therebetween of 10 μm or more and 100 μm or less; and wherein assuming that the outer surface of the developing roller where the square region is put is charged with a discharging wire disposed parallel to the longitudinal direction of the developing roller and at a location 2 mm away from the outer surface of the developing roller, by applying a direct voltage of −5 kV between the substrate and the discharge wire in an environment of a temperature of 23° C. and a relative humidity of 50%, and assuming that the square region is equally divided by 50 straight lines parallel to one side of the square region and 50 straight lines perpendicular to the straight lines, a potential at each point of intersection between those straight lines with an electrical force microscope is measured, and a potential map of the charged outer surface of the developing roller on which the square region is put, is created, the presence of each of the two electrically insulating domains satisfying the condition 1, is ascertained in the potential map.

* * * * *